US010458747B2

(12) United States Patent
Ringgenberg

(10) Patent No.: US 10,458,747 B2
(45) Date of Patent: Oct. 29, 2019

(54) APPARATUS FOR PREVENTION OF DROPPING OF HANDGUN

(71) Applicant: Dirk D. Ringgenberg, Madrid, IA (US)

(72) Inventor: Dirk D. Ringgenberg, Madrid, IA (US)

( * ) Notice: Subject to any disclaimer, the term of this patent is extended or adjusted under 35 U.S.C. 154(b) by 253 days.

(21) Appl. No.: 15/489,816

(22) Filed: Apr. 18, 2017

(65) Prior Publication Data

US 2017/0219312 A1 Aug. 3, 2017

Related U.S. Application Data

(60) Division of application No. 14/617,226, filed on Feb. 9, 2015, now Pat. No. 9,651,336, and a division of application No. 14/617,226, filed on Feb. 9, 2015, now Pat. No. 9,651,336, which is a continuation-in-part of application No. 14/196,097, filed on Mar. 4, 2014, now abandoned.

(60) Provisional application No. 61/778,585, filed on Mar. 13, 2013.

(51) Int. Cl.

| | |
|---|---|
| ***F41C 33/00*** | (2006.01) |
| ***F41C 23/10*** | (2006.01) |
| ***F41C 27/00*** | (2006.01) |
| ***F41C 33/08*** | (2006.01) |
| ***F41A 17/02*** | (2006.01) |
| ***F41A 35/00*** | (2006.01) |
| ***F41A 17/00*** | (2006.01) |

(52) U.S. Cl.

CPC ..... *F41C 33/008* (2013.01); *F41A 17/00* (2013.01); *F41A 17/02* (2013.01); *F41A 35/00* (2013.01); *F41C 23/10* (2013.01); *F41C 33/00* (2013.01); *F41C 33/001* (2013.01); *F41C 33/08* (2013.01); *F41C 27/00* (2013.01); *Y10T 24/1365* (2015.01); *Y10T 24/1368* (2015.01); *Y10T 24/1397* (2015.01)

(58) Field of Classification Search

CPC ..... F41C 33/00; F41C 33/001; F41C 33/08; F41C 27/00; F41C 23/10

USPC ..... 224/218; 294/25

See application file for complete search history.

(56) References Cited

U.S. PATENT DOCUMENTS 1,274,481 A * 8/1918 West ..... A41D 13/082 2/20
2,855,683 A * 10/1958 Wayant ..... B65G 7/12 294/25
3,927,808 A * 12/1975 Steen ..... F41C 23/02 224/267
4,982,522 A * 1/1991 Norton ..... F41C 33/00 224/220
5,361,525 A * 11/1994 Bowes ..... F41A 17/02 42/70.06
5,666,667 A * 9/1997 Hook, Jr. ..... A41D 19/01547 2/159

(Continued)

*Primary Examiner* — Justin M Larson

(57) ABSTRACT

An apparatus for preventing the dropping of a handgun during use thereof is shown in conjunction with a special glove that has metal parts attracted to magnetic grips attached to a hand gun, an electromagnetic version of the magnetic grip device, several embodiments of a strap attached to a grip on one side of a gun handle, a spring steel strap for attachment to a hand gun handle that will stay straight when moved to the straight position and coils around a person's wrist when moved from the straight position and lastly and O-ring device attached to a special glove to automatically attach to a tapered tail on a hand gun.

6 Claims, 19 Drawing Sheets

(56) References Cited

U.S. PATENT DOCUMENTS 5,864,884 A * 2/1999 Salvitti ..... A41D 19/01547 2/159
5,964,073 A * 10/1999 Harper ..... E04G 21/20 294/25
6,029,321 A * 2/2000 Fisher ..... F41C 33/001 124/35.2
6,073,381 A * 6/2000 Farrar ..... F41C 23/10 42/71.02
6,195,927 B1 * 3/2001 Fortenberry ..... F41C 33/001 42/90
6,230,371 B1 * 5/2001 Chu ..... F41C 33/001 24/17 B
6,678,986 B2 * 1/2004 Roush ..... A41D 19/0157 2/159
6,802,148 B1 * 10/2004 Danas ..... F41C 23/10 42/71.02
7,021,358 B2 * 4/2006 Landi ..... B29C 70/30 156/579
7,305,718 B2 * 12/2007 Avallone ..... A41D 19/01582 2/11
8,317,242 B2 * 11/2012 Yu ..... F41C 33/001 2/161.5
8,833,820 B1 * 9/2014 Hill ..... G06F 1/1626 224/218
9,651,336 B2 * 5/2017 Ringgenberg ..... F41C 33/008
D813,339 S * 3/2018 Maroney ..... D22/108
10,054,392 B2 * 8/2018 Maroney ..... F41C 23/10
10,151,558 B2 * 12/2018 Jennings ..... F41A 23/18
2005/0188587 A1 * 9/2005 Danas ..... F41C 23/10 42/72
2005/0268515 A1 * 12/2005 Key-Carniak ..... F41C 23/10 42/71.02
2007/0017138 A1 * 1/2007 Young ..... F41C 33/001 42/71.01
2007/0278262 A1 * 12/2007 Gallagher ..... F41C 23/02 224/150
2012/0242098 A1 * 9/2012 Yu ..... F41C 33/001 294/25
2014/0259539 A1 * 9/2014 Ringgenberg ..... F41C 33/008 24/13
2015/0168098 A1 * 6/2015 Ringgenberg ..... F41C 33/008 24/3.2
2016/0313086 A1 * 10/2016 Maroney ..... F41C 23/10
2018/0142986 A1 * 5/2018 Jennings ..... F41A 23/18

* cited by examiner

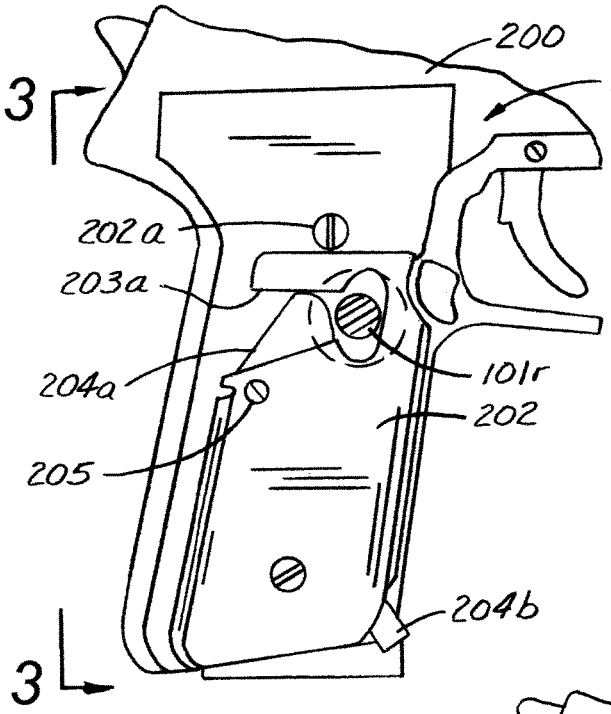
Fig. 12
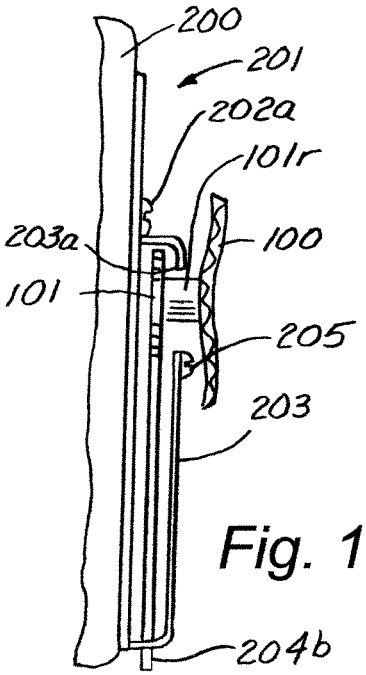
Fig. 13
Fig. 14
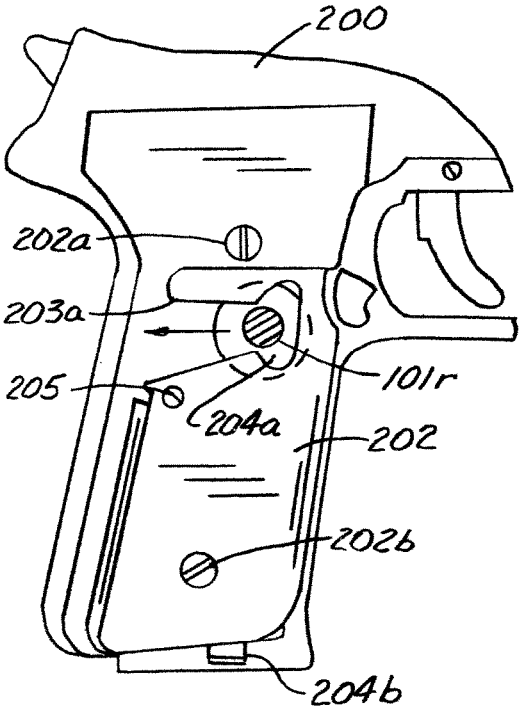

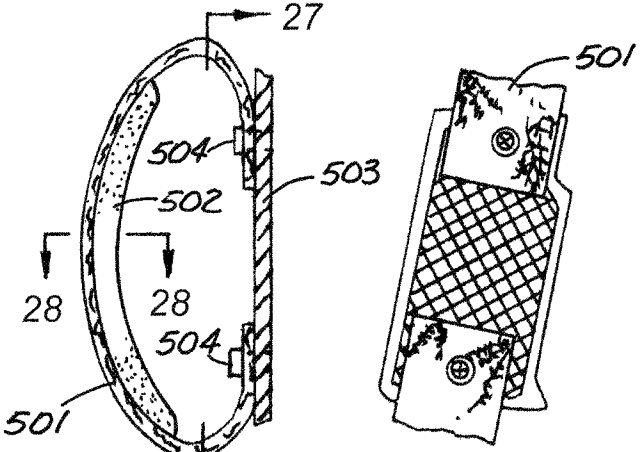
Fig. 27
Fig. 26
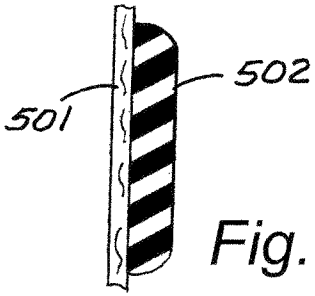
Fig. 28
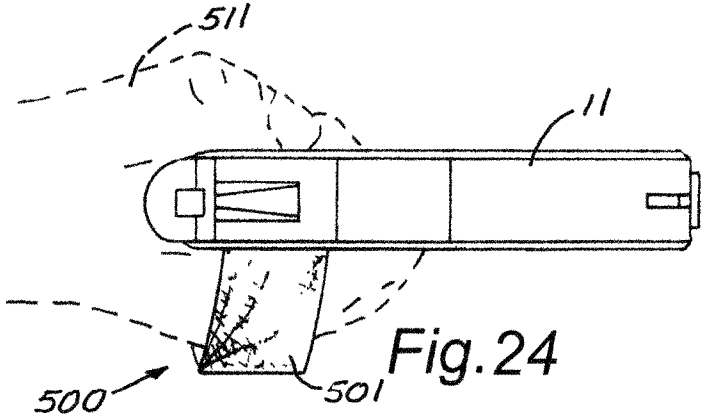
Fig. 24
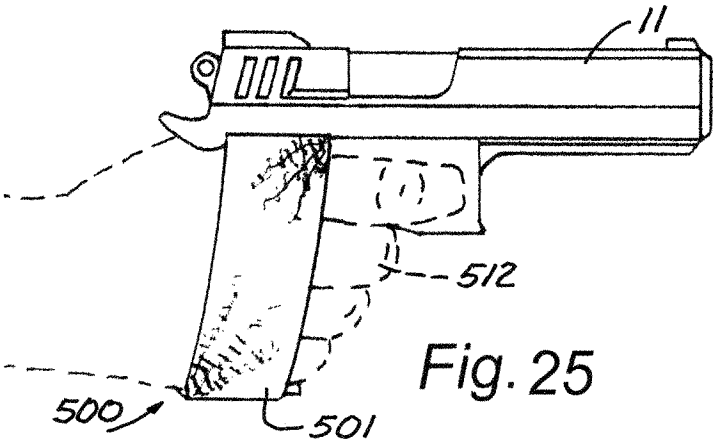
Fig. 25

11
600
601
608
606
607
605
611

33
33
608
608
609

APPARATUS FOR PREVENTION OF DROPPING OF HANDGUN

CROSS-REFERENCE TO RELATED APPLICATIONS

This application is a Divisional of U.S. Ser. No. 14/617,226 filed Feb. 9, 2015, entitled Apparatus for Prevention of Dropping a Handgun which is a continuation in part of U.S. patent application Ser. No. 14/196,097 filed Mar. 4, 2014 and this application claims the benefit of priority of U.S. patent application Ser. No. 14/196,097 and of U.S. Provisional Patent Application Ser. No. 61/778,585 filed Mar. 13, 2013 entitled "Apparatus for Prevention of Dropping of Handgun", all of which are incorporated by reference herein in their entirety.

TECHNICAL FIELD

This invention relates generally to an apparatus to prevent a hand gun user from dropping his or her weaton during use.

BACKGROUND

During the operation of shooting a firearm such as a handgun, typically the operator grabs the weapon from a holster and holds the weapon in their hand during use. In general, after firing or during use, the weapon can be dropped, lost or dislodged from the operator's hand, leaving the operator vulnerable in a firefight situation. Without the weapon, the operator is defenseless and unable to protect himself/herself or others.

U.S. Pat. No. 4,982,522 to Norton; U.S. Pat. No. 5,864,884 to Salvitti, U.S. Pat. No. 6,230,371 to Chu; U.S. Pat. No. 6,678,986 to Roush and Published U.S. Patent Application No. 2007/0278262 to Gallagher, all of which are incorporated herein by reference in their entirety, address the aforementioned problem to some extent but suggest solutions that are quite cumbersome to use during the urgency of battle.

Accordingly, there is a need for simpler and more reliable solutions to the problem.

BRIEF DESCRIPTION OF THE DRAWINGS

The above needs are at least partially met through provision of the method and apparatus described in the following detailed description, particularly when studied in conjunction with the drawings, wherein:

FIG. 12 is an enlarged partial view of the handle part of the handgun of FIG. 11 when the glove of FIGS. 6 and 7 has been received in a slot in a locking mechanism and is locked into the locking mechanism;

FIG. 13 is a view taken along line 13-13 of FIG. 12 to show that the button of the glove of FIGS. 6 and 7 has been received in a slot in a locking mechanism and is locked into the locking mechanism;

FIG. 14 is an enlarged partial view of the handle part of the handgun like FIG. 11 but showing the locking mechanism completely retracted so the button can be received in the cavity or slot as shown in FIG. 13, but before the locking mechanism moves back to the FIG. 12 position;

FIG. 24 is a top view of an alternate embodiment;

FIG. 25 is a right-hand plan view of the alternate embodiment of FIG. 25 showing a person's hand in dashed lines;

FIG. 26 is a cross sectional view of the grip and gun retaining strap of the FIGS. 24 and 25 embodiment;

FIG. 27 is a cross sectional view taken along line 27-27 of FIG. 26;

FIG. 28 is a cross sectional view taken along line 28-28 of FIG. 26;

FIG. 41C and finally to FIG. 41D;

FIG. 43 attached to the wrist of a user;

Figure 1:
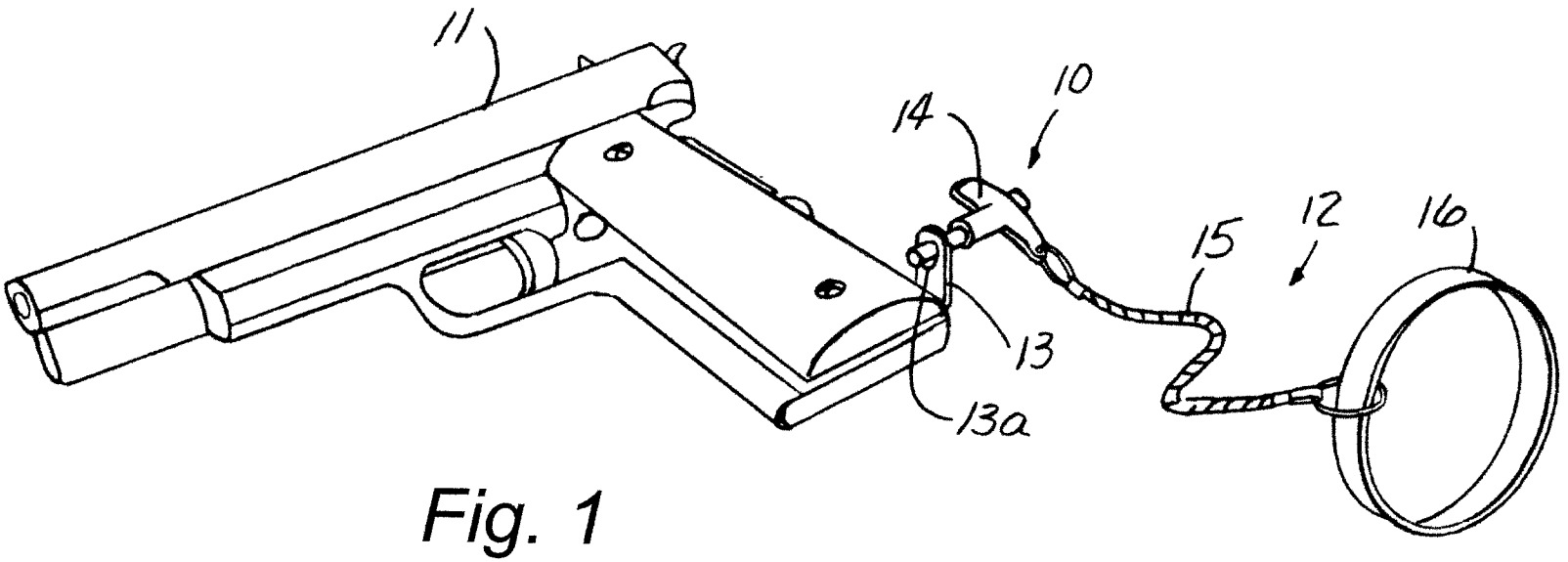
FIG. 1 is a perspective view of a handgun having a first embodiment of the present invention attached thereto.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Referring now to the drawings, wherein like reference numerals indicate identical or similar parts throughout the several views, FIGS. 1-5 show an apparatus 10 constructed in accordance with a first preferred embodiment of the invention to prevent the dropping of a handgun during use.

Figure 2:
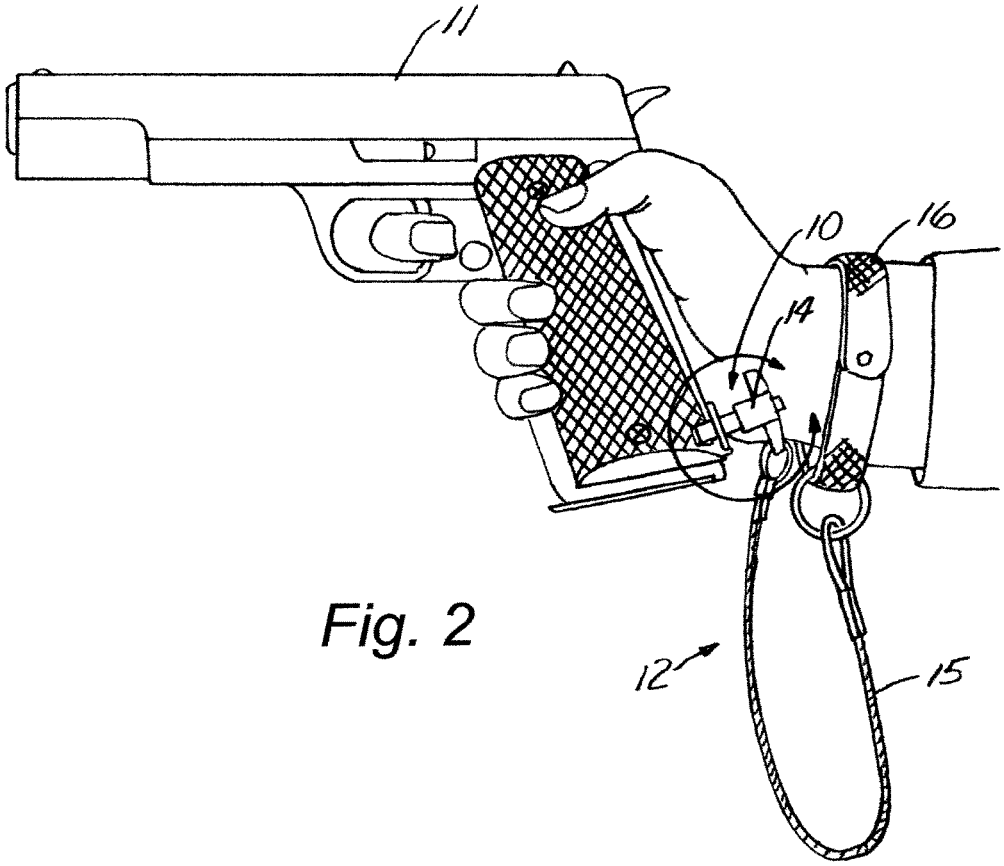
FIG. 2 is a side elevational view of the present embodiment of FIG. 1 in use.
Figure 5:
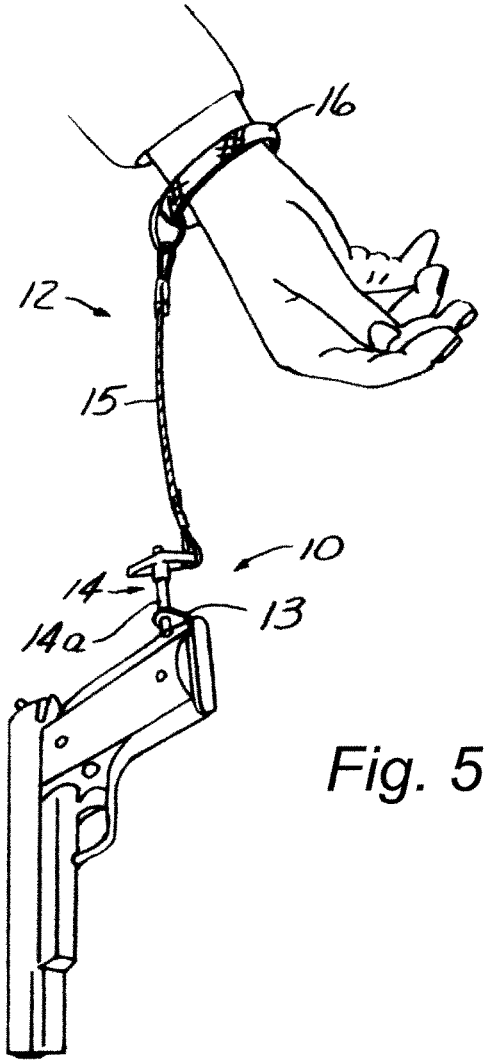
FIG. 5 is a perspective view of the embodiment of FIG. 1 but showing what happens if the handgun becomes dislodged from the users hand during use thereof.

A handgun 11 has a flange 13 attached to the handle thereof as shown in FIGS. 1, 2 and 5. The flange 13 has an opening 13*a* therein to receive a pin 14*a* of pin 14. Small metal balls 14*b* lock the pin 14*a* from being removed from the opening 13*a* in flange 13 so long as the button 14*c* is not pushed in. To release the pin 14*a* from the flange 13, one would just hold the handle portions 14*h* with one's fingers while pushing in (to the left in FIG. 3) so that a cam inside the pin part 14*a* does not push the balls 14*b* outwardly to the position shown in FIG. 3. These locking pins 14 are on the commercial market and are available from many different sources, such as Kwik-Loc™ pins from Jergens Industrial Supply, or Ball-Lok® pins from Avibank Manufacturing, Inc. Other types of pins can be used instead of the specific type of locking pin shown in FIGS. 1-5 if desired.

The handle 14*h* has a hole in it and a cable 15 is attached there through it on one end of the cable 15. The other end of the cable 15 is attached to a wrist band 16, which can be made of a solid plastic material with some elastic properties so it can be slipped over a user's hand for example. But the strap 16 could be a Velcro® brand nylon strap or any other type of reliable strap.

The projection (14*b*) is a spherical member disposed in a hole (14*h*) in the pin (14), the hole (13*a*) being smaller than the spherical member (14*b*) to allow the spherical member (14*b*) to project from the hole (14*h*) in a first position (FIG. 3A) thereof but not fall out of the hole. The spherical member (14*b*) has a second position (FIG. 3B) not projecting significantly out of the hole (14*x*). A cam member (14*c*) is disposed at least partially inside of the pin (14) and is biased by a compression spring (14*s*) to a first position (FIG. 3A) wherein the spherical member (14*b*) is pushed to the first position thereof and the cam (14*c*) is moveable to a second position (FIG. 3B) thereof permitting the spherical member (14*b*) to move to the second position thereof. An enlarged portion on one end of the pin is a handle (14*h*), the handle having a button, part of cam (14*c*), thereon attached to the cam (14*c*) and being moveable with the cam (14*c*).

Figure 3:
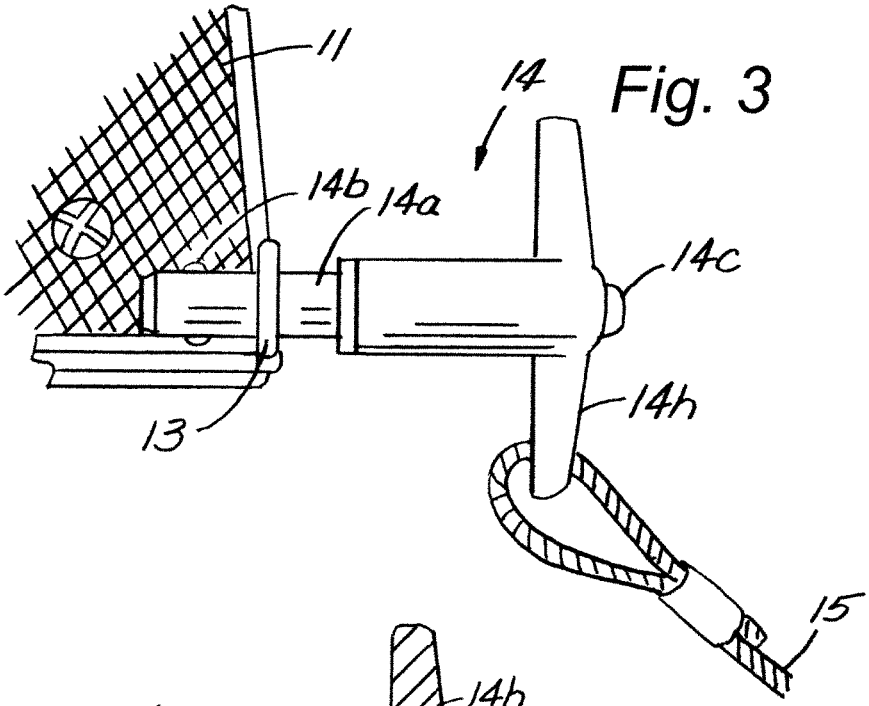
FIG. 3 is an enlarged partial side view of the circled part labeled "3" in FIG. 2.
Figure 3A:
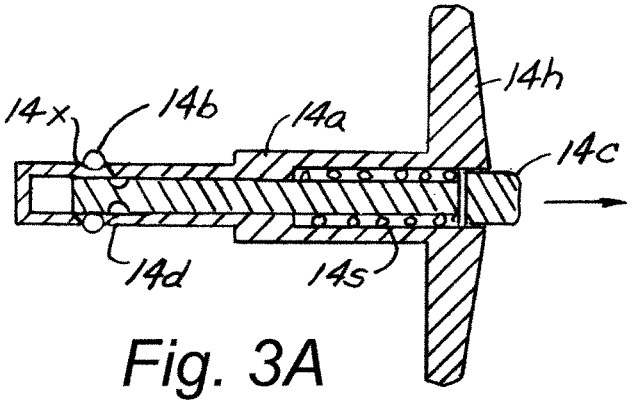
FIG. 3A is a cross sectional view taken through pin shown in FIG. 3.
Figure 3B:
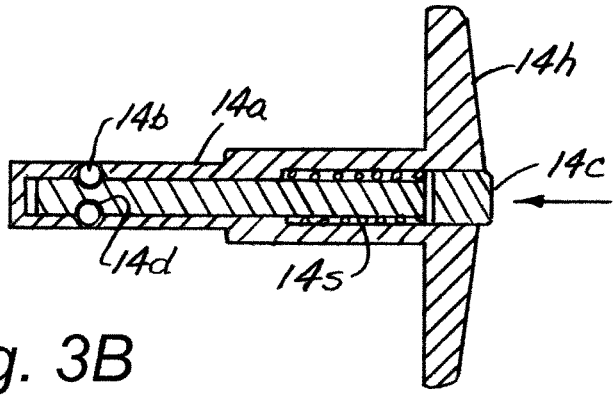
FIG. 3B is a cross sectional view like FIG. 3A but with the button pushed in to move a cam to allow spherical cam members to move inwardly.
Figure 4:
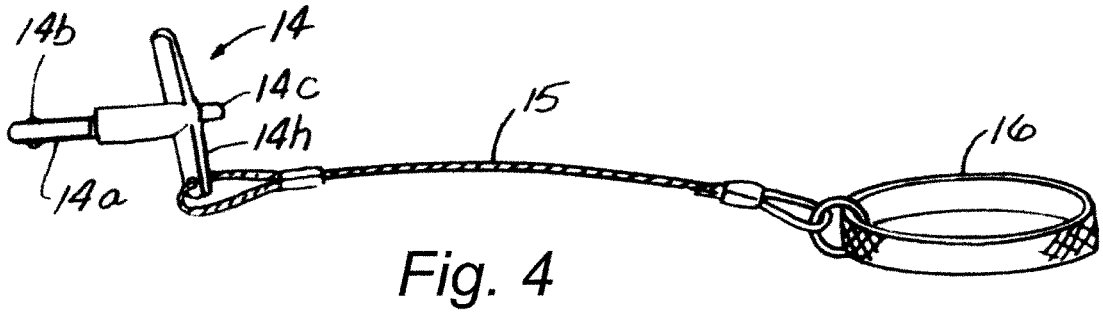
FIG. 4 is a perspective view of the embodiment of FIG. 1 shown separated from the handgun.

In use of the embodiment 10 of FIGS. 1-5 a user would have the strap 16 around the user's hand as shown in FIG. 2, but can place the handgun in a holster, not shown. The user would then just push on the pin 14*c* and remove the pin 14*a* from the flange 13 until such time the user decides that the device is needed. At such time the user would grasp the handgun 11 from the holster, push on the pin 14*c* and insert the pin 14*a* into the flange 13 as shown in FIGS. 1-3. The user could then use and fire the handgun 11 as shown in FIG. 2 with one or two hands. If for any reason the handgun 11 would be dislodged from the user's hand, it would still be tethered to the user's wrist as shown in FIG. 5. That way the user could quickly place the handgun back in the user's hand in the position shown in FIG. 2.

FIGS. 6-14 show an apparatus 110 constructed in accordance with a second preferred embodiment of the invention to prevent the dropping of a handgun during use.

Figure 6:
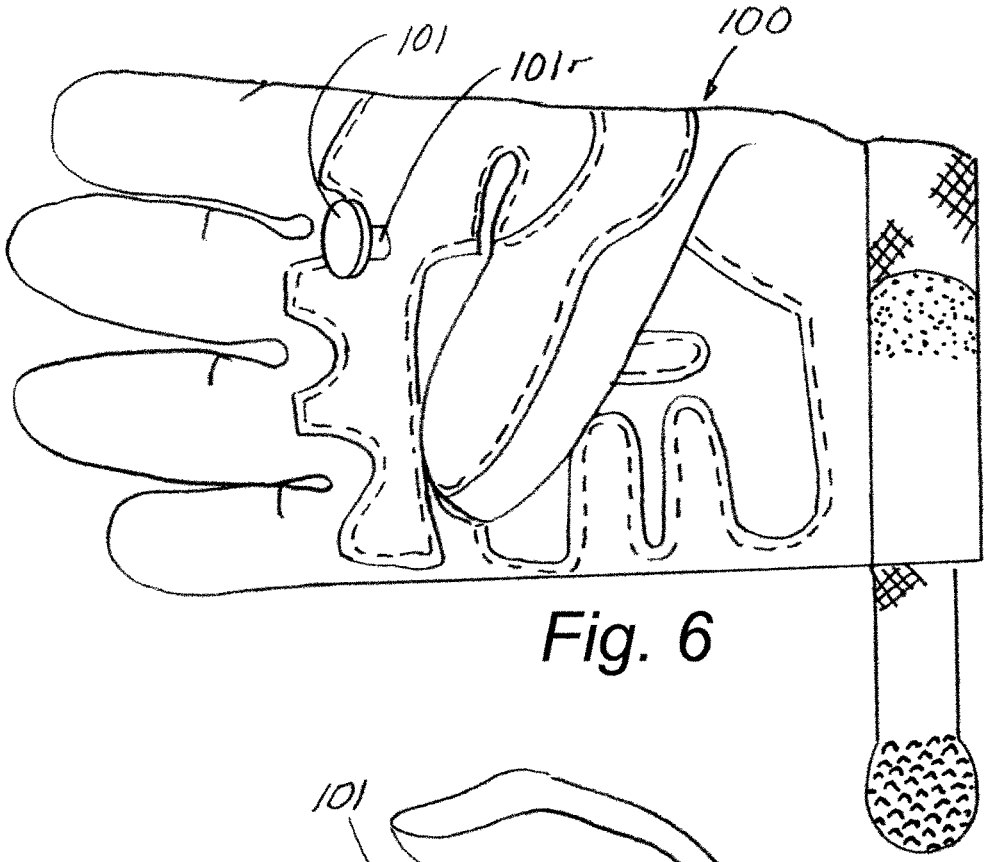
FIG. 6 is a top view of the glove portion of the second embodiment of the present invention when not on the hand of a user.
Figure 7:
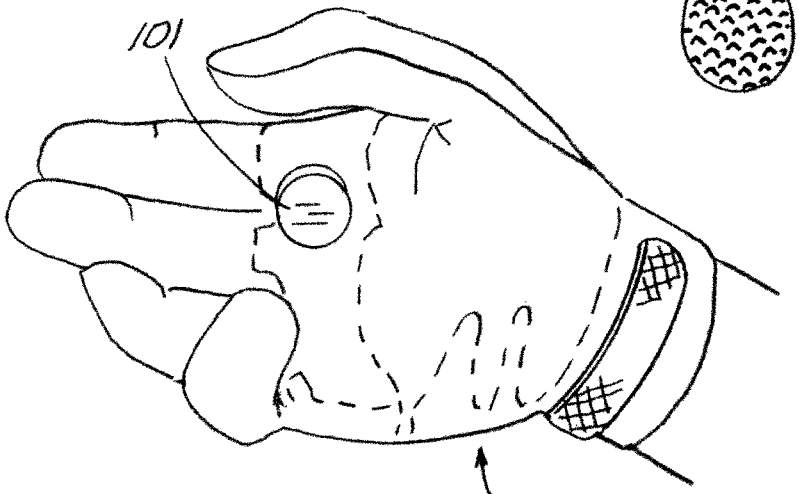
FIG. 7 is a perspective view of a glove portion of a second embodiment of the present invention shown on the hand of a user.
Figure 8:
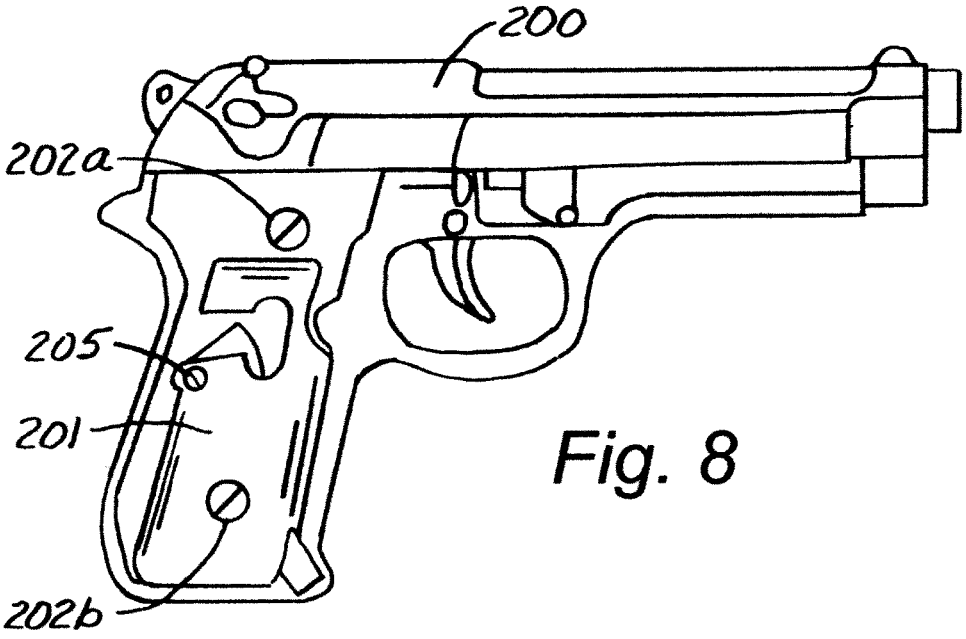
FIG. 8 is a side elevational view of a handgun using the second embodiment of the present invention, which is used in combination with the glove shown in FIGS. 6 and 7.

FIGS. 6 and 7 show a right handed glove 100 with a rivet type button 101 that could be attached to the glove similar to the way that metal buttons are attached to the top front of Levis® brand blue jeans, though the present invention is not limited to that manner of attaching the button 101 to the glove.

The glove 100 of FIGS. 6 and 7 would be used in conjunction with a locking mechanism 201 attached to the right side of the hand grip of a handgun 100. It will of course be understood that a left side device could also be used in conjunction with a left handed glove similar to that shown in FIGS. 6 and 7.

Figure 9:
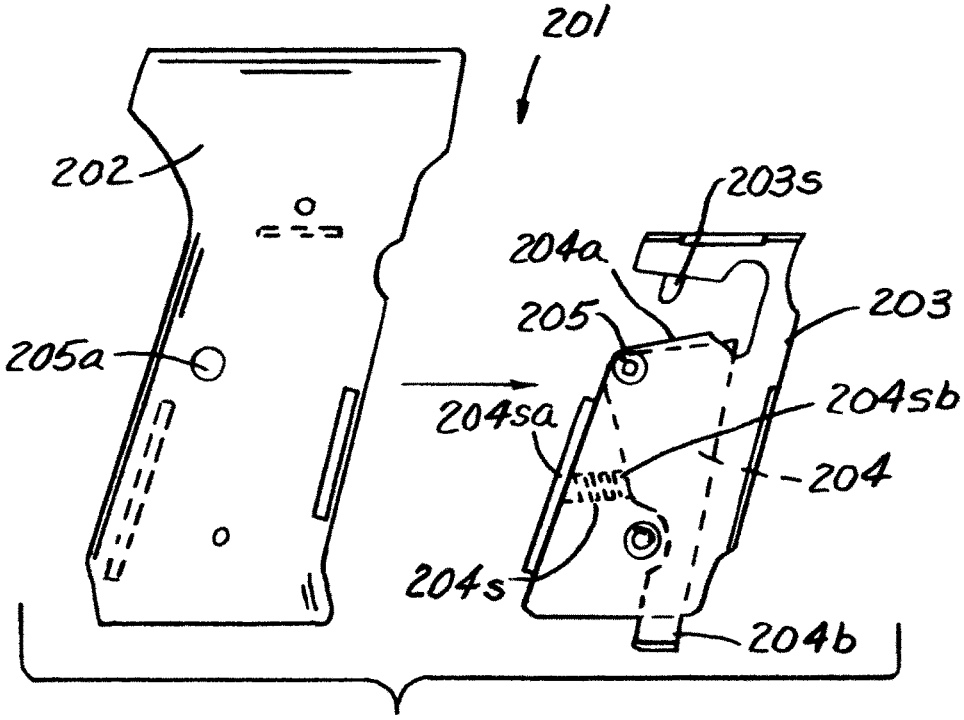
FIG. 9 is a side elevational exploded view of the handle part of the handgun of FIG. 8 with the normal hand grips removed in readiness to receive a latching mechanism of the second embodiment.

Looking to FIG. 9, the locking mechanism has a first member 202 that is attached by first by screw/bolt 202*a* to the handle of the handgun 200 after the original handgrip (not shown) on that side of the handgun 200 has been removed. Then a second assembly part 203 shown in FIG. 9 would be attached to the first member 202 by a screw/bolt 202*b* and the fact that a pin 205 that pivotally attaches a locking member 204 to the assembly part 203 fits into an opening 205*a* in first member 202.

Figure 10:
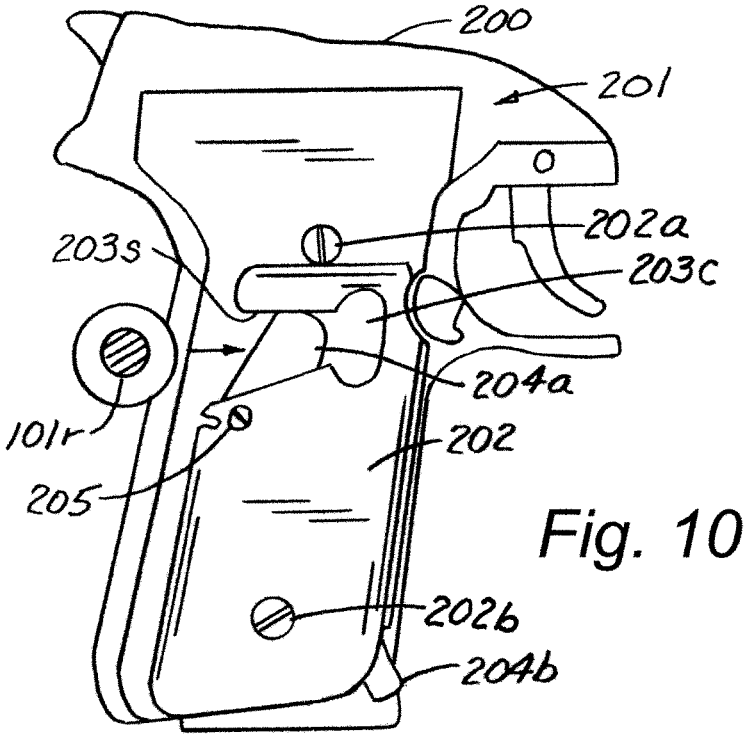
FIG. 10 is an enlarged partial view of the handle part of the handgun of FIG. 8 just before a user with the glove of FIGS. 6 and 7 would grasp the handgun from a holster showing how an enlarged metal button structure would be close to, but not in a slot in which it is designed to be received.
Figure 11:
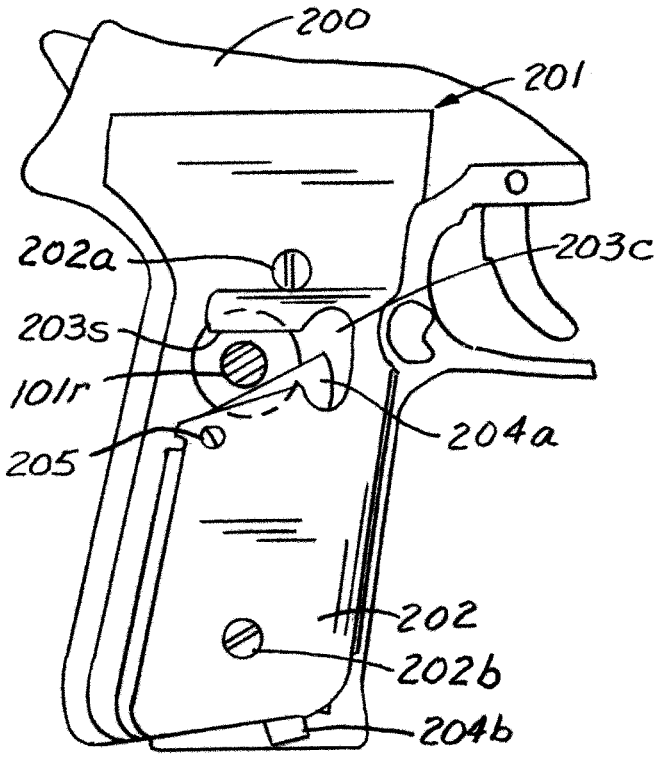
FIG. 11 is an enlarged partial view of the handle part of the handgun of FIG. 10 when the button of the glove of FIGS. 6 and 7 has been received in a slot in a locking mechanism but before the button is locked into the locking mechanism.

A compression spring 204*s* is attached at one end 204*sa* to the member 203 and at the other end 204*sb* to the lever 204 so as to bias the lever 204 to the position shown in FIG. 10 but allow the lever 204 to move out of the way from the FIG. 10 position to the FIG. 14 position. Then as the rivet portion 101*r* of the button 101 moves to the FIG. 11 position it will push the lever portion 204*a* out of the way until the rivet portion 101*r* is moved into opening or cavity 203*c* as shown in FIG. 13. Once the rivet portion 101*r* is in the FIG. 12 position, the compression spring 204*s* will push the lever 204 back to the FIG. 10/12 position, thereby locking the gun 200 to the glove 100, even though some pivoting of the gun with respect to the glove can occur. It is to be understood that instead of using a compression spring 204*s*, a torsion spring around the pin 205 could be used, or a tension spring pulling the bottom part of the lever 204 to the right as shown in FIG. 9.

The gun 200 could then be used without fear of it ever dropping out of the user's hand. And when the user decides that he/she wants to remove the glove 100 from the handgun 200, the user would merely need to move the lever portion 204*b* from the position shown in FIGS. 8, 10 and 12 to the position shown in FIG. 14 by moving the lever 204*b* to the left from the FIG. 12 position to the FIG. 14 position to allow the rivet 101*b* to be moved to the left out of the slot 203*s*, at which time the lever 204*b* can be released.

Figure 16:
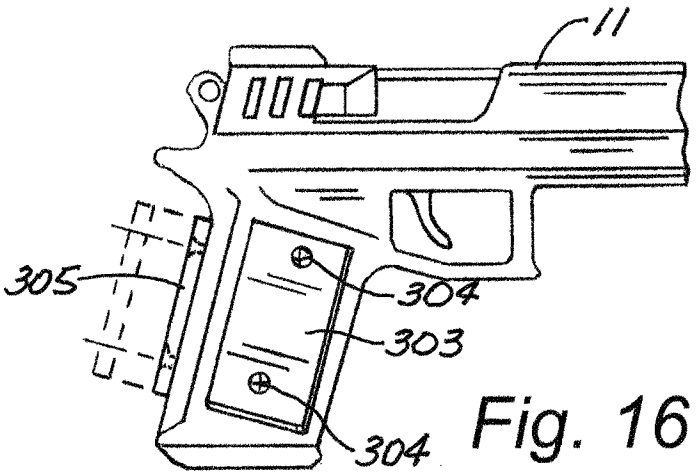
FIG. 16 is a side elevational view of the gun shown in FIG. 15 with detachable magnetic plates on the back and side of the grip.
Figure 15:
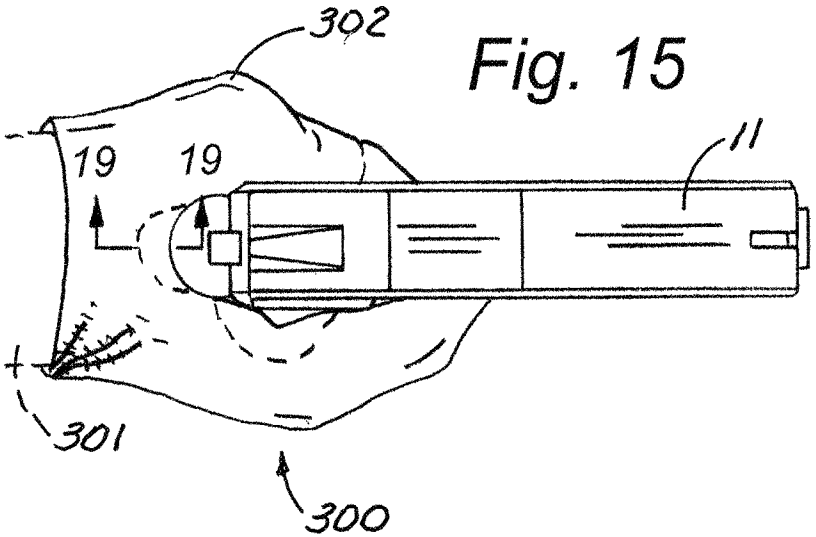
FIG. 15 is a top view of an embodiment of the present invention using a special glove to secure a handgun to the person using it.
Figure 17:
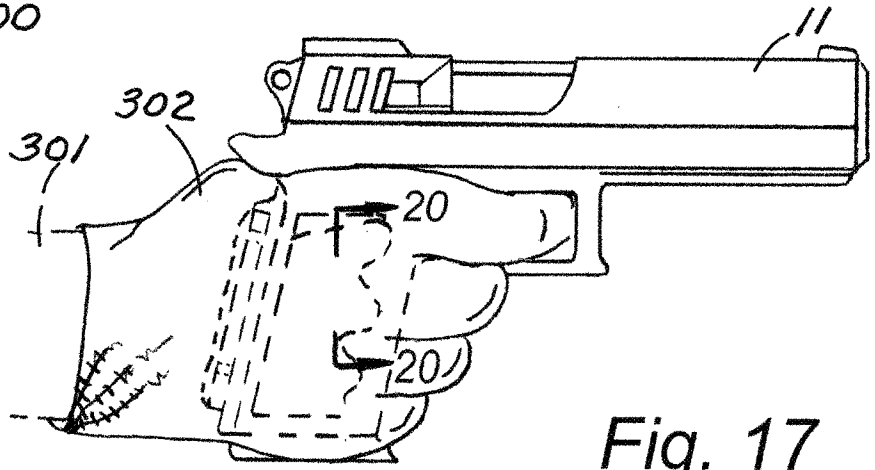
FIG. 17 is a side elevational view like FIG. 16 but showing the handgun being used with a special glove and certain parts shown in dashed lines.

Referring again to the drawings wherein like reference numerals designate identical or corresponding parts throughout the several views, FIG. 15 shows a handgun (11) being held by a person whose wrist is shown as (301) and a glove (302) on the person's hand. FIG. 16 shows the handgun (11), but the grip portion (303) is a magnet attached by screws (304). Also on the back of the grip, another magnetic plate (305) is attached by screws (not shown). Referring now to FIG. 17, it is a side elevational view of the person (301) holding the handgun (11) with the glove (302).

Figures 18, 19, 20, 21, 22:
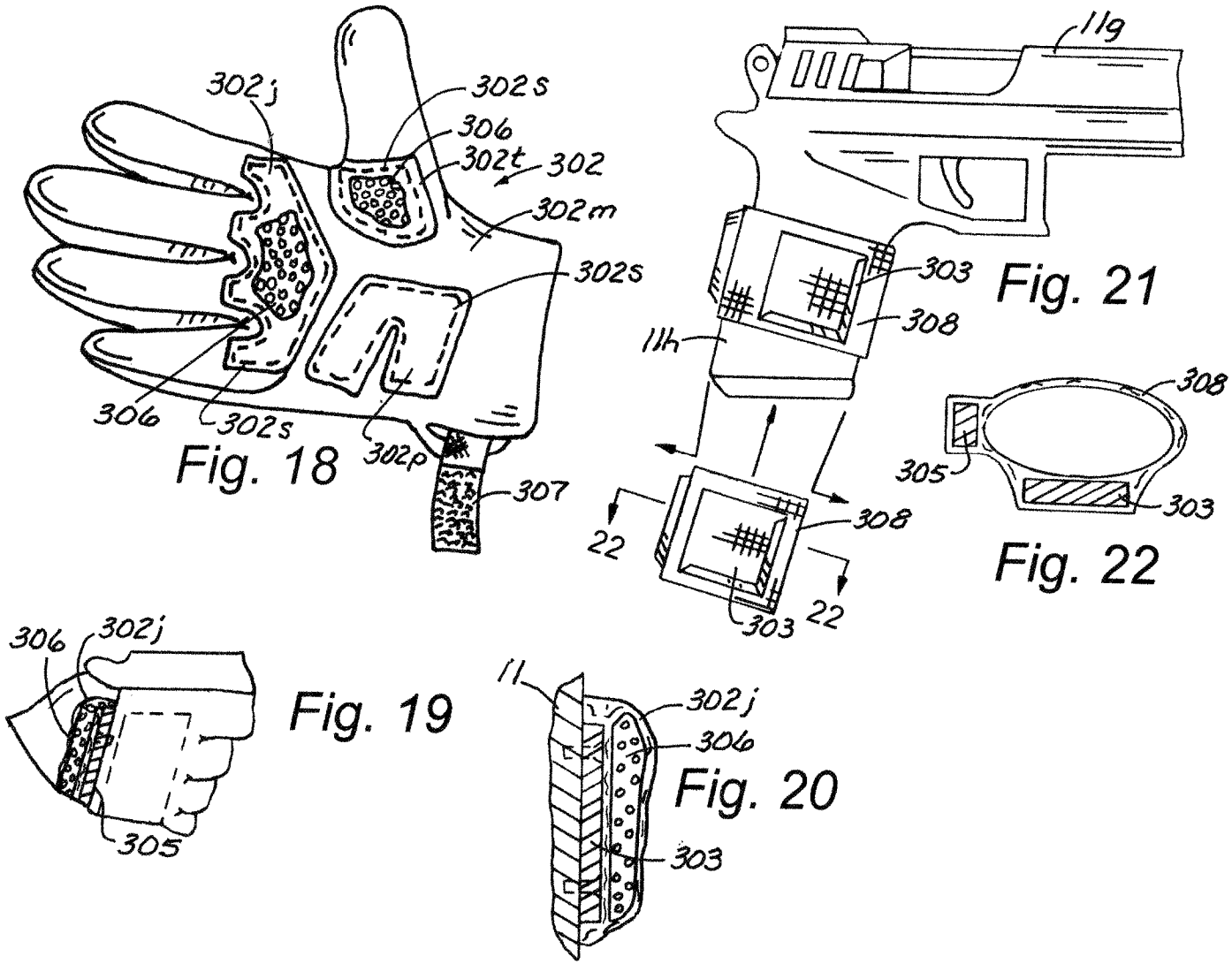
FIG. 18 is a plan view of the palm portion of a glove to be used with the embodiment of FIGS. 15-17 and 21.
FIG. 19 is a cross sectional view taken along line 19-19 of FIG. 15 and showing steel shot in the glove being attached magnetically to a magnet on the back side of the grip of the handgun.
FIG. 20 is an enlarged cross sectional view like FIG. 19, but from the other side.
FIG. 21 is a side elevational view showing a rubber or elastic band with pockets that permits attachment of the magnets shown in FIG. 16 to be attached to a handgun which does not have detachable grips.
FIG. 22 is a cross sectional view along line 22-22 of FIG. 21 showing the rubber grip with the magnets embedded in pockets therein.

The glove (302) is shown in more detail in FIGS. 18, 19 and 20. The main part of the glove (302*m*) has several pockets sewn therein, a first pocket (302*p*) is on the palm and has steel shot disposed therein, the purpose of which will be explained later. The pocket (302*j*) is on the joint area between the fingers and the palm and steel shot (306), such as shot used in shotgun shells, is disposed therein for reasons which will be explained later. Similarly, patch (302*t*) at the base of the thumb also has steel shot (306) sewn between the patch (302*t*) and the glove (302). The patch (302*t*) is shown broken away to show the steel shot (306) therein but the top of the patch (302*j*) would actually be solid and sewn along threads or stitches (302*s*). Similarly threads (302*s*) are shown in dashed lines in FIG. 18 on patch (302) and also on patch (302*j*). A VELCRO® brand hook and loop strap (307) is preferably provided to hold the glove (302) tightly around the wrist of the user.

Referring now to FIG. 19, it can be seen that the steel shot (306) in pocket (302*j*) attaches to magnet (305) when close to the magnet (305) to prevent the user from being separated from the handgun (11). Similarly, the pocket (302*p*) would attach to the magnetic replaceable grip (303) in FIG. 16 as shown in dashed lines in FIGS. 17 and 20. The handgun (11), referring to FIG. 20, has the magnetic plate (303) thereon and the glove with the pocket (302*j*) and steel shot (306) causes the plate (303) and steel shot (306) to be held closely together by the magnetic force of the magnetic plate (303) to prevent the user from losing contact with the handgun (11). It is to be understood that in this embodiment of FIGS. 15 through 22, only one of the magnetic plates (303) and (305) or the like needs to be used. Similarly, the corresponding pockets that are present in the glove of FIG. 18 to be attracted to such magnets (303 and 305) can be eliminated if a corresponding magnet (303) or (305) has not been attached to the handgun (11).

Referring now to FIG. 22, it is noted that a rubber expandable sleeve (308) has the magnets (303) and (305) inside of pockets instead of attaching them by screws to the gun handle as shown in FIG. 16. This FIG. 21 embodiment is required for certain handguns, such as some GLOCK® brand models, which are made without removable grips. The sleeve (308) is shown in FIG. 21. It is placed on the handle (11*h*) of the handgun (11), much like a rubber band could be placed around the handle if that were desired, so that the magnet (305) and (303) are held in the proper position on the handle of the handgun (11).

Accordingly, in both of the embodiments shown in FIGS. 15-20 and 21, the identical glove (302) of FIG. 18 can be used to grasp the handgun (11 or 11*g*) as shown in FIGS. 15 and 17. When the glove (302) is in a position on the handgun (11) shown in FIG. 16, or the handgun (11*g*) of FIG. 21, the operation will be exactly the same wherein the steel shot (306) will be attracted to the magnets (303) and (305) to prevent the user from dropping the handgun (11) or (11*g*).

Although in the FIGS. 15-22 the first magnetic material of the plates (303/305) are shown as magnets and the magnetic portion (306) of the glove is steel shot of the type used in shotgun shells, it is to be understood that the plates (303/306) could be partially or completely made of a magnetic material like ferrous material attracted to magnets such as steel and a magnet or magnets could be in the pockets 302*j*/302*p*/302*t*. In other words, for the purpose of this document the general term "magnetic" means either a magnet or a material attracted to magnets or both.

Figures 23A, 23B, 23C:
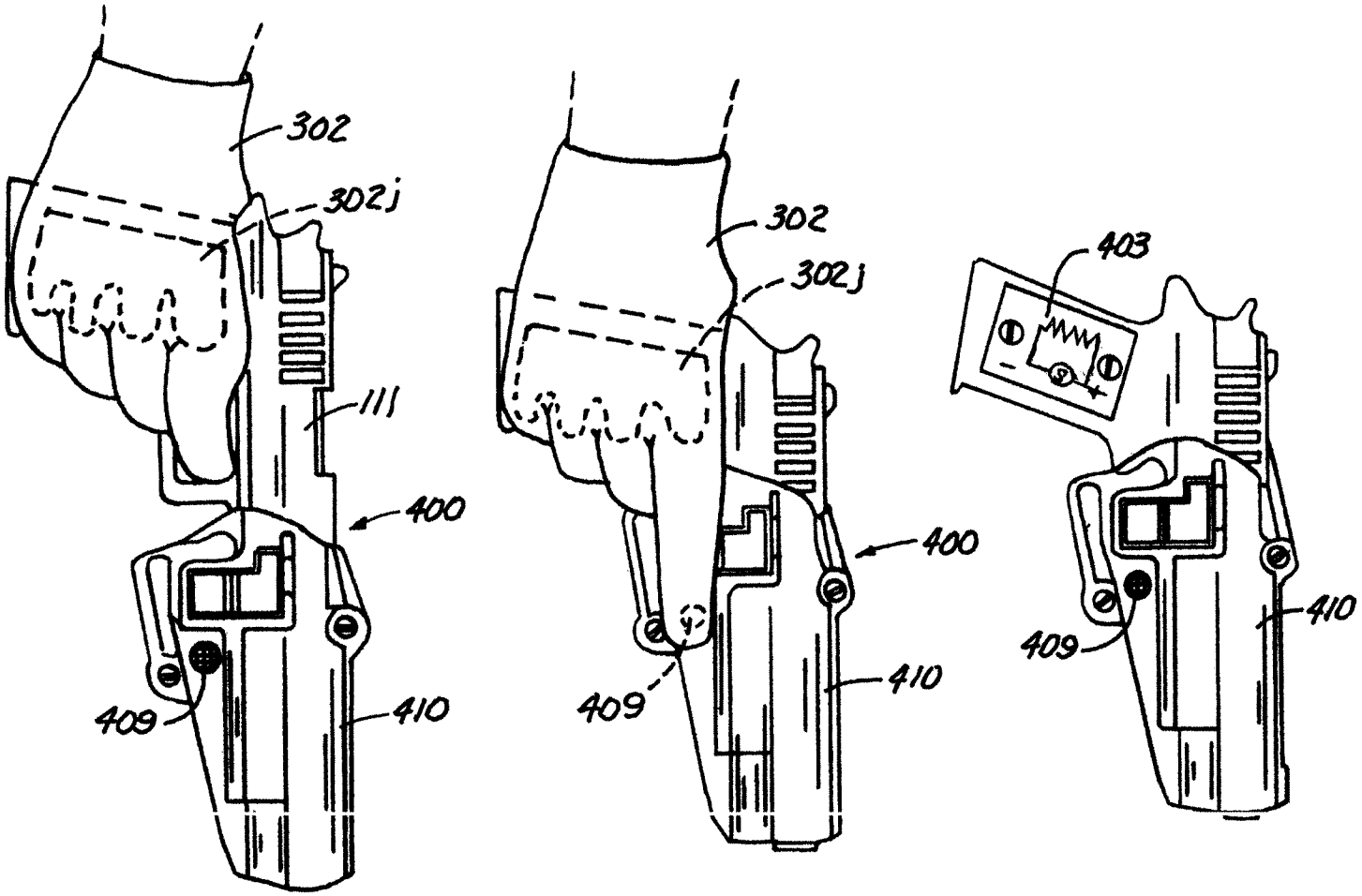
FIG. 23A shows a person wearing the magnetic glove of FIG. 18 putting the handgun in a hard holster.
FIG. 23B shows the person's index finger pushing on a button to release an electromagnetic magnet in the handle grip of the firearm to thereby allow the glove to be released from the handle of the handgun.
FIG. 23C shows the hand and glove completely removed from the gun and holster after the electromagnet has been deactivated.

Referring now to the embodiment of FIG. 23A-23C, it is noted that an electromagnetic plate (403) is used instead of a permanent magnet (303) like that shown in FIG. 16. In order to activate or de-activate the electromagnet, a button (409) is provided on the holster which will turn the electromagnet (403) on or off. The electromagnet (403) defaults to "on" while it is outside of the holster (410) so that the user will not be able to drop the handgun (11) inadvertently when the glove is connected to the handle plate (303) of FIGS. 16 and 17. But when the user puts the handgun (11) back into the holster (410) and pushes the button (409), as shown in FIG. 23B, this turns off the electricity to the electromagnet (403) and allows the user to remove the glove (302) since the magnetic attraction is gone between the electromagnetic plate (403) and the steel shot inside of pocket (302*j*) in the glove (302).

It is to be understood that the button (409) can be on the handgun (111) itself, instead of on the holster (410). In that case, a battery would be inside the handgun (111) and the button (s/409) (FIG. 23C) would be on the handgun (111) so the button is accessible when the handgun is in the position of FIG. 23B. Alternatively, the button can be arranged to be automatically pushed by the handgun itself when the handgun is in the position shown in FIG. 23B, thereby automatically turning off the electromagnet (403), permitting the user to remove the glove (302) from the electromagnetic grip (403). The magnetic portion (403), best shown in FIG. 23C, is an electromagnet (403) which can selectively be turned on or off by using a switch (s/409) on the handgun (111) or on a holster (410).

Referring now to FIGS. 24-28, a handgun (11) has a strap (501) attached by screws (504) that hold the grip (503) to the handgun handle. The flexible strap (501) can be of any material such as neoprene, leather, or the like and preferably has a foam pad or thick neoprene portion (502) on the inside thereof to help make the person's hand, shown in dashed lines (511) inside the strap (501) in FIGS. 24-26.

In use of the device of FIGS. 24-28, the user merely inserts his or her fingers (512) through the strap (501) and the strap and/or foam (502) stretches enough to hold the handgun tightly enough so that the user will not drop the handgun (11).

Referring now to FIGS. 29-36, still another embodiment of the no-drop handgun holding device is shown with a handgun (11) (FIG. 29) wherein a user (611) is shown in dashed lines. A strap (601), similar or identical to that shown in FIGS. 24-28 as strap (501-502), can be used. Additionally, in the embodiment shown in FIGS. 33-36, a wrist-strap portion (605) is pivotally attached by pivot (606) and connecting portion (607) to further secure the person's hand and wrist to the handgun (11).

Figures 29, 30, 31, 32, 33:
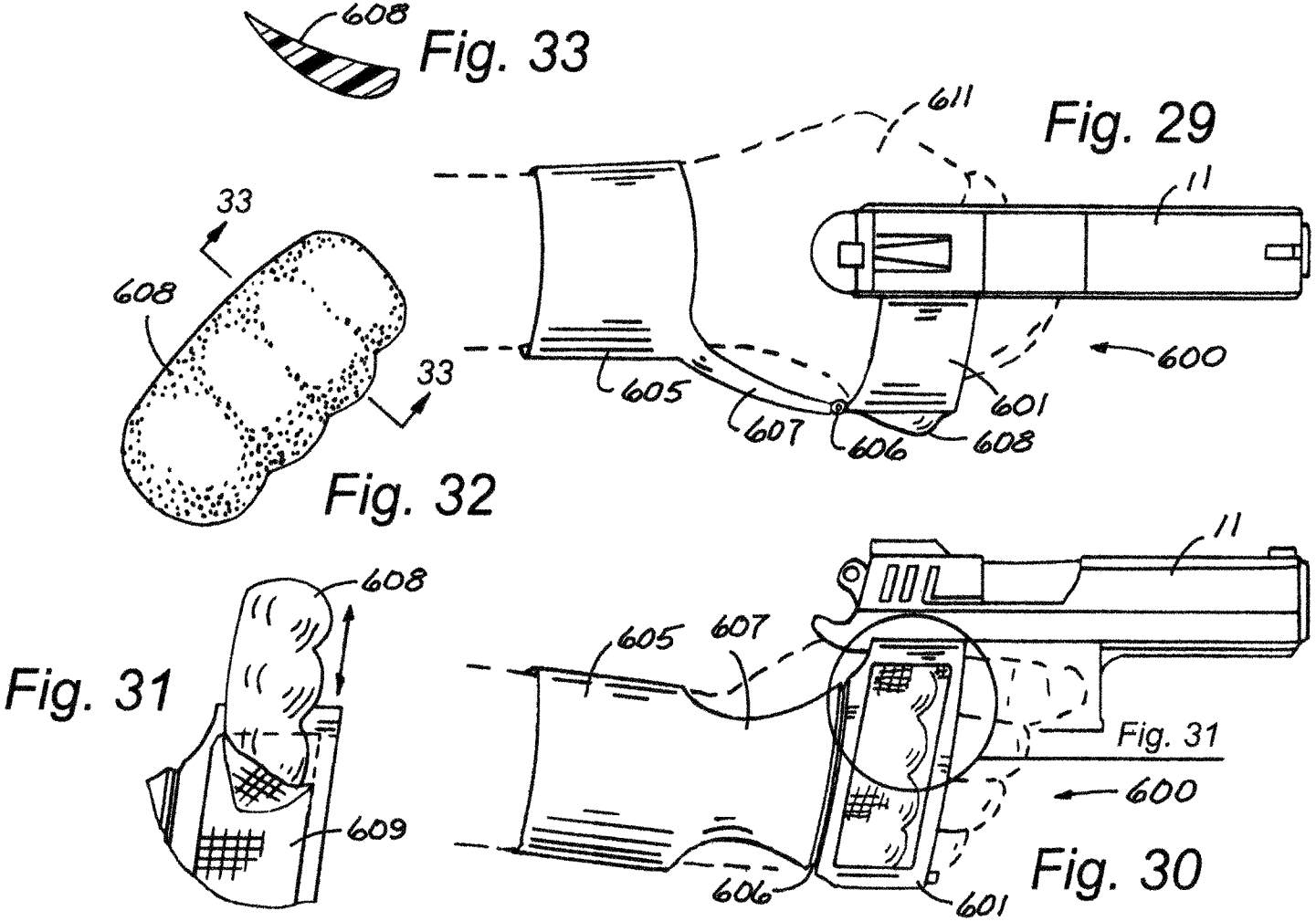
FIG. 29 is a top view of an alternate embodiment and showing a person's hand in dashed lines.
FIG. 30 is a right side elevational view of the embodiment shown in FIG. 29.
FIG. 31 is a view of a LEXON® brand plastic insert being inserted into or from a pocket in a strap of the device of FIGS. 29 and 30.
FIG. 32 is a top plan view of the LEXON® brand plastic knuckle protecting device of FIGS. 30 and 31.
FIG. 33 is a cross sectional view taken along line 33-33 of FIG. 32.

A knuckle-protecting portion (608) can optionally be provided. This knuckle-protecting portion (608) is shown in FIGS. 30, 31 and 32. The knuckle protection portion (608) is shown by itself in FIG. 32 in general and in FIG. 31 it shows how the knuckle-protecting piece can be put into a pocket (609) in the strap (601). This can be important because when, in a combative situation, the user may need to break a window, push on a door, or even push the knuckle-portion (608) against an adverse combatant. The member (608) can be compared in some respects to a commonly-used combatant device referred to as "brass knuckles", and for the same purposes in general, but the member (608) is preferably made of a plastic such as that marketed under the LEXAN® brand.

It is noted that the hinge (606) is optional and can be merely the flexible nature of the material of members (601), (605) and (607), i.e. it can just be a continuous piece of material such as leather, neoprene or the like.

Figure 34:
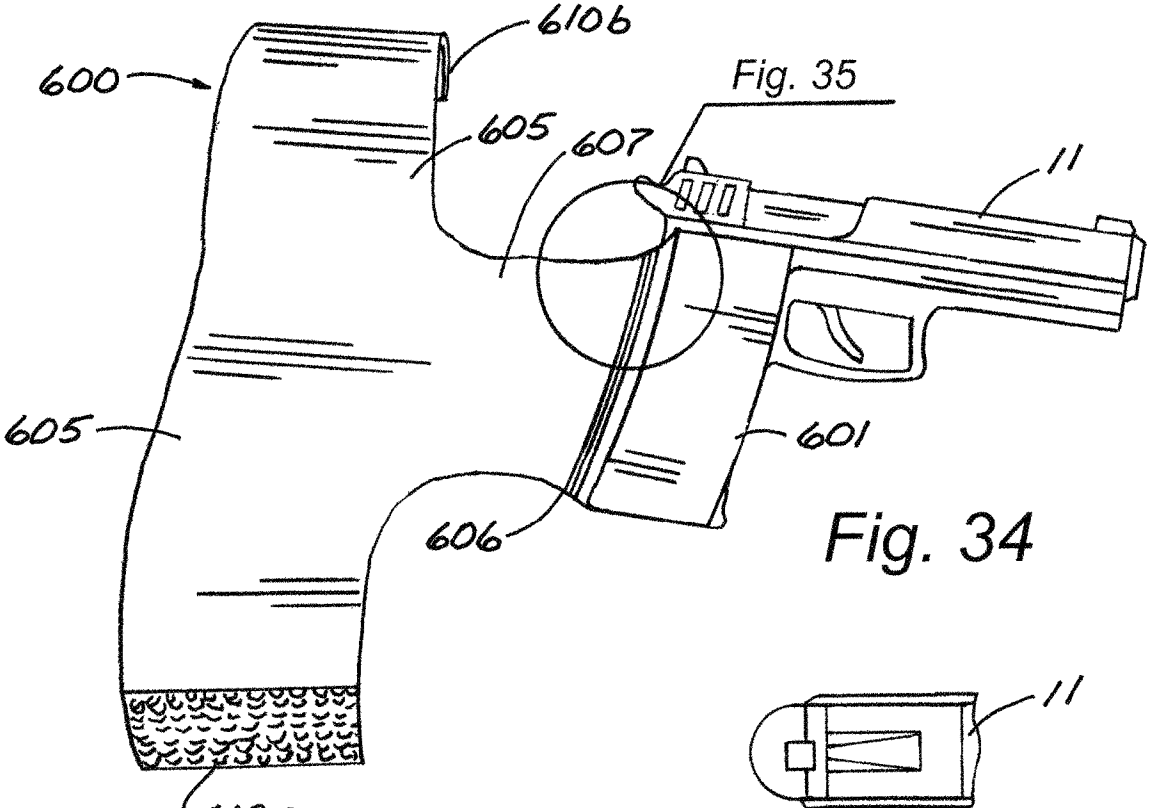
FIG. 34 is a side elevational view of the embodiment of FIGS. 29 and 30 but showing the forearm part of the device open before or after it is attached to the forearm, and showing a hinge to allow the rear most part of the device to pivot outwardly or inwardly.
Figure 35:
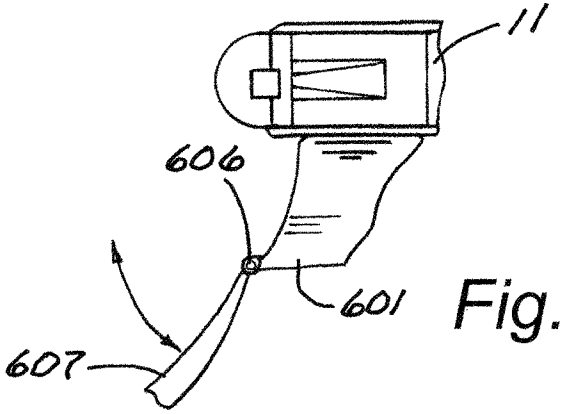
FIG. 35 is a view from the top of the circled area shown in FIG. 34.

Referring now to FIGS. 34 and 35, it is noted that the portion (605) of the device for wrapping around the wrist of the user can have a generic or VELCRO® brand hook portion (610*a*) and a generic or VELCRO® brand loop portion (610*b*) thereon.

Figure 36:
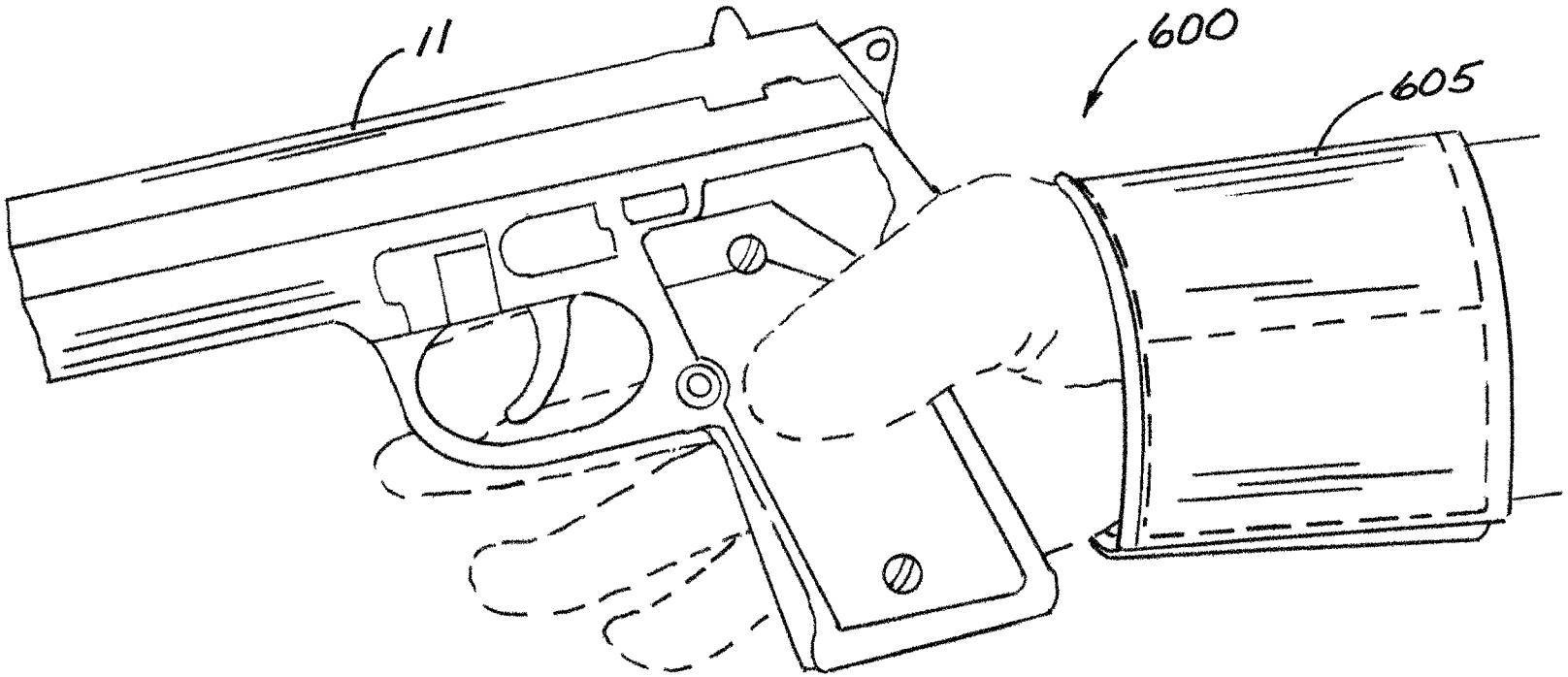
FIG. 36 is a view from the other side of the handgun shown in FIG. 30 with the gun holding device wrapped around the user's hand, the hand being shown in dashed lines.

FIG. 35 shows the hinge (606) from a top view of the circle portion FIG. 35 shown in FIG. 34. FIG. 36 shows the other side of the device shown in FIGS. 30 and 33, and also shows in dashed lines a person's hand and fingers holding onto the handgun (11).

Accordingly in use the device shown in FIGS. 30-36 is merely attached by the person (611) pushing their fingers through the strap (601) when the device is in the position shown in FIG. 34 and then wrapping the portion (605) around the person's wrist as shown in FIGS. 29, 30 and 36 until the hook and loop fasteners (610*a* and 610*b*) are connected. Then it will be impossible for the person to inadvertently lose the handgun (11) in a combatant or other stressful situation.

A further embodiment is shown in FIGS. 37-44. The apparatus shown in FIGS. 37-41D, the right-handed version, is not designed to be in a holster, but instead is designed to be close by to a user, such as placed in a drawer or the like, in the position in FIGS. 37 and 38. A spring steel member (701) is shown inside a cloth or plastic sleeve (702) in FIGS. 39 and 40. This spring steel strip (702) can best be compared to what is inside of a steel tape measure, such as that shown in FIG. 41A which will just be referred to as metal tape (710). It is important to understand that when a tape measure of the type having a metal spring steel tape such as (710) disposed therein is straightened, it will stay straight, (like "dead center) but when pushed out of the "dead center" position and allowed to curl, such as shown in FIG. 40A, then the metal (701) inside of strap (702) will curl as will be explained below.

Figure 38:
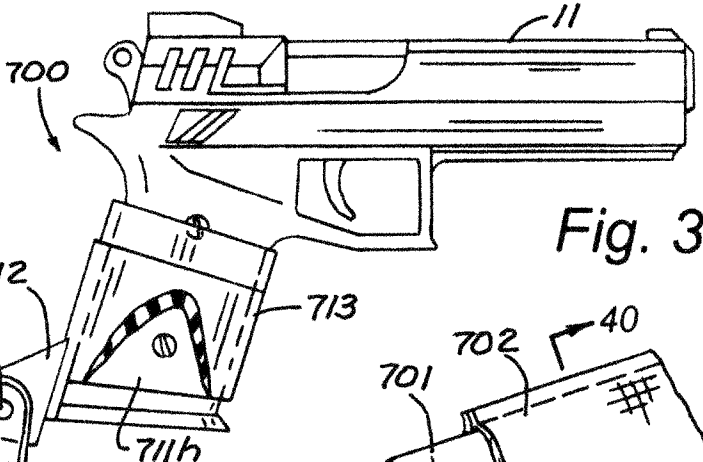
FIG. 38 shows a right side view of the device of FIG. 37.
Figure 39:
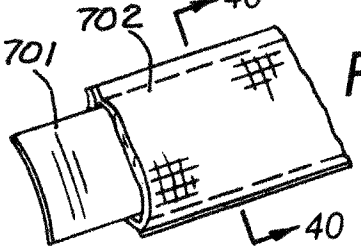
FIG. 39 shows a perspective view of a portion of a metal strip sewn inside of a cloth or plastic material, the metal being shown in cross section in FIG. 40.
Figure 37:
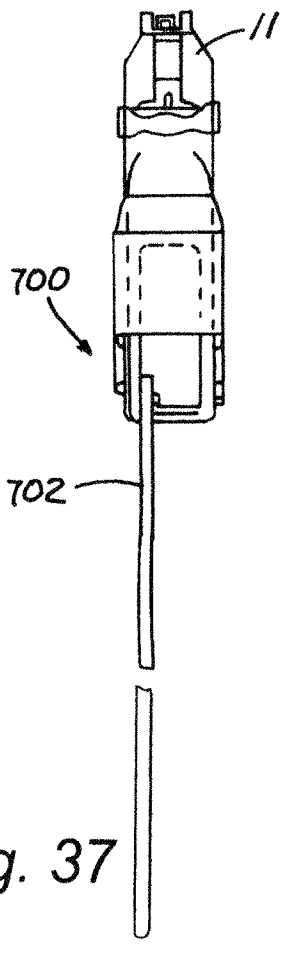
FIG. 37 is a rear elevational view of still another preferred embodiment of the present invention which will be referred to as a "flip strap"

FIGS. 37 and 38 show the strap (702) that has the steel member (701) inside of it and, as explained above, this strap (702) will stay straight when placed in a straight position and not disturbed. Consequently, the device shown in FIG. 38, if it were placed in the bottom of a drawer with the member (702) lying along the bottom of the drawer, then it would be ready for the user to use when needed.

Figure 40:
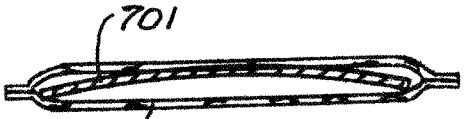
FIG. 40 is a cross sectional view taken along line 40-40 of FIG. 39.
Figure 40A:
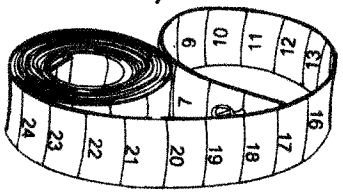
FIG. 40A is a perspective view of a metal tape measure that would be used inside of a metal tape measure housing, to illustrate that the embodiment of FIGS. 37-40 is using the same general type of material for reasons with will be explained below.

When in that straight position, the strap (702) will remain straight, much like the tape (710) of FIG. 40A would remain straight on the right end if it were biased to the straight position. As soon as the strap (702) with the metal insert (701) therein begins to move from a straight position, then it will automatically want to roll to a position, for example as shown in the rolled portion of tape (710) shown in FIG. 40A.

Looking again to FIGS. 37-40, the strap (702) is attached at a pivot point (711) to a flange (712) which is held to the grip (713) which can be merely a rubber sleeve, tightly held around the grip (711*h*). It is to be understood that this bracket (712) could be on the bottom of the handle grip (711*h*) or it could be on the other side of the handle grip (711*h*), for example as shown in FIGS. 42-44 for the left-hand model illustrated therein.

Figures 41A, 41B, 41C, 41D:
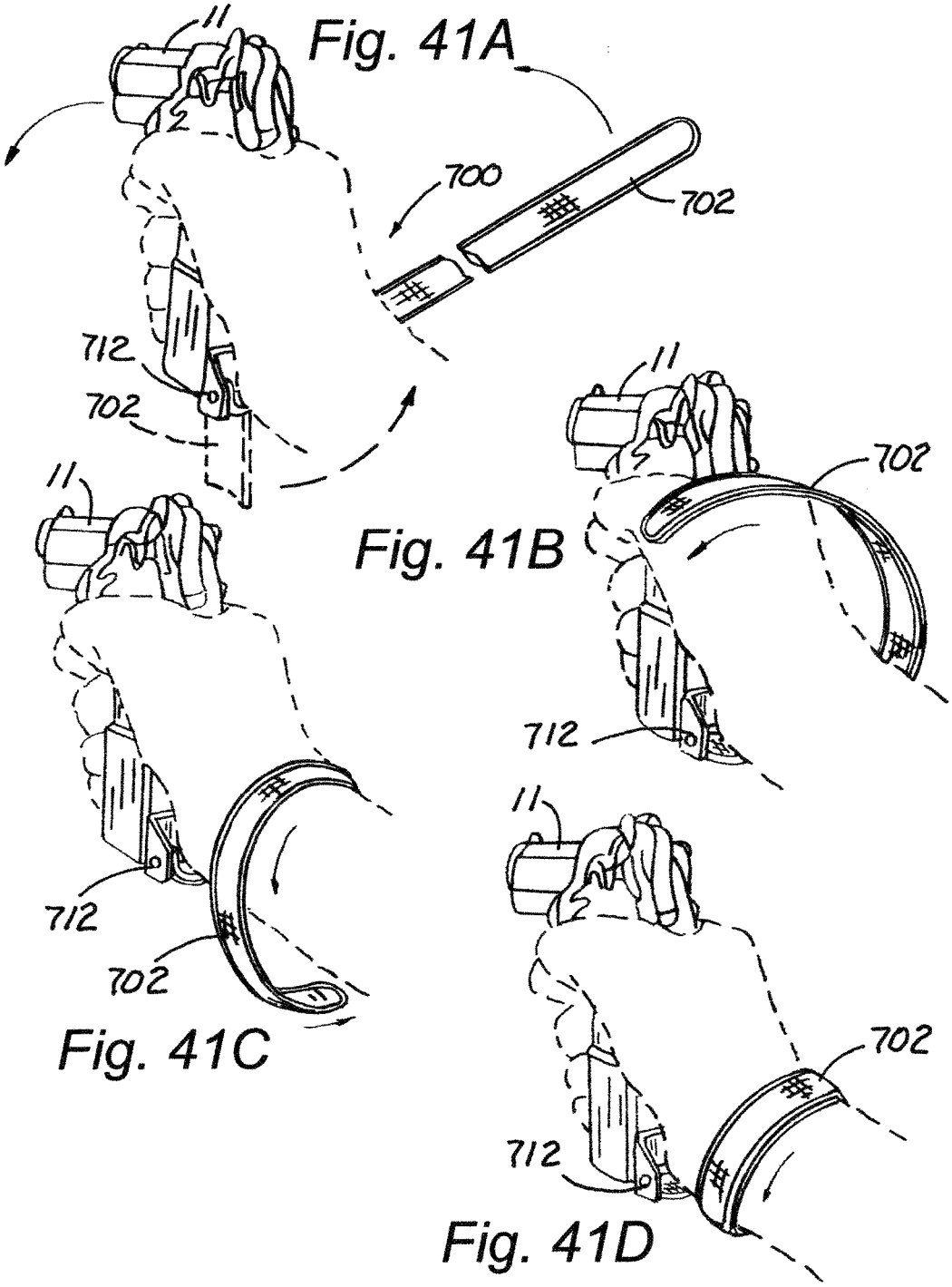
FIG. 41A graphically illustrates a first step of how to use the embodiment of FIGS. 37-40 when the handgun is used by a right-handed person who grabs the device with the strap extended and twists his or her arm in a counterclockwise direction as shown in FIG. 41A, then sequentially the strap will go from the dead center position shown in dashed lines in FIG. 41A to the solid position line in FIG. 41A and then in FIG. 41B, sequentially to the position shown in FIGS. 41C and 41D.
FIG. 41B shows a next or second position of the strap as it coils around the user's wrist toward the position to which the metal is biased as shown in FIG. 40A.
FIG. 41C being a next snapshot in time of the metal strap moving to its coiled position, it being understood that the strap moves in less than a second from the dashed line position shown in FIG. 41A through position of FIG. 41B.
FIG. 41D is the final position of the strap wrapped around the wrist of a user.

To use the device (700) shown in FIGS. 37-41, a person would first grasp the handgun out of the drawer in the position of FIG. 41A where the strap (702) is straight, like it is also shown in FIGS. 37 and 38 and in dashed lines in FIG. 41A. After that, the user would quickly twist his/her wrist in a counterclockwise direction as shown in FIG. 41A and this momentum will, by overcoming inertia, cause the strap (702) to also move in a counterclockwise direction shown by the arrow above FIG. 41A. The strap will quickly move on its own to the curled position, which is shown sequentially in FIGS. 41A to 41D, to move around the user's wrist first to the position of FIG. 41A, then sequentially through the four positions from that shown in FIG. 41A to the position in FIG. 41B, quickly to the position shown in FIG. 41C and finally to the position shown in FIG. 41D. This takes a fraction of a second for the strap to move from the straight-down dashed line position shown in FIG. 41A to the final attached position shown in FIG. 41D because of the coiling of the metal (701) inside the strap (702) as previously explained. The user will then be able to handle the handgun (11) in the FIG. 41D position without fear that the handgun will somehow be lost during a combatant or other stressful situation.

Figure 43:
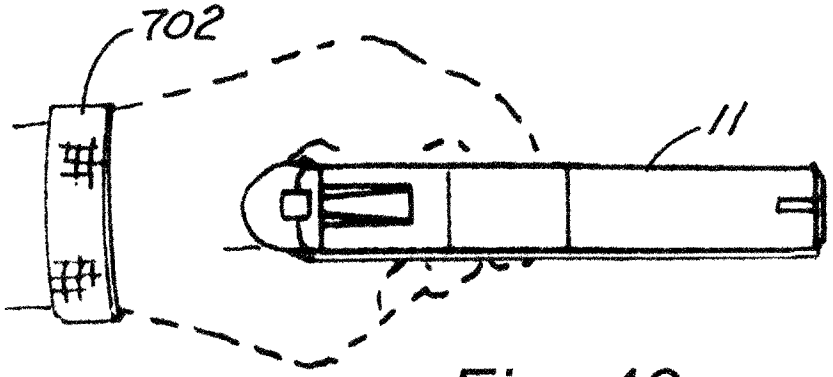
FIG. 43 is a top view of the embodiment of FIG. 42 attached to a user's wrist.
Figure 44:
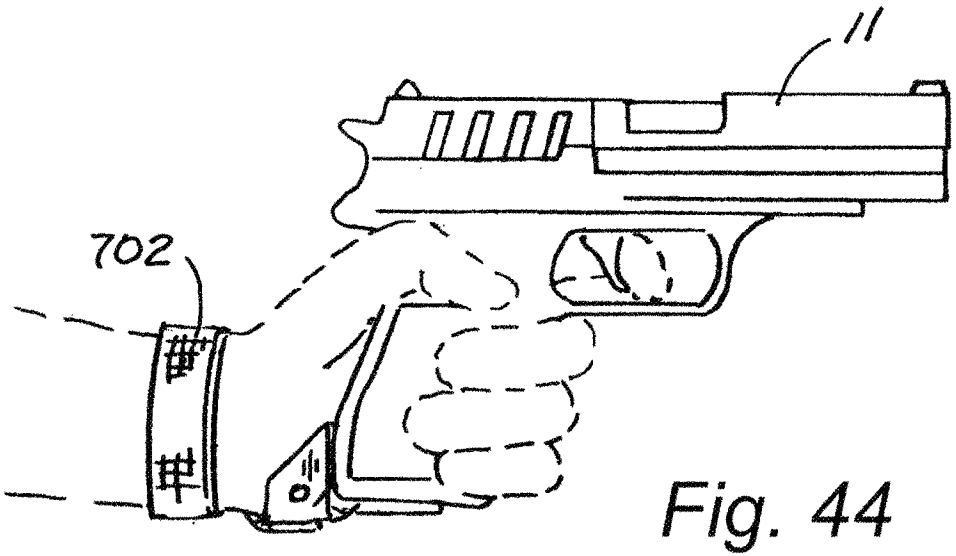
FIG. 44 is a side elevational view of the device shown in FIG. 42.
Figure 42:
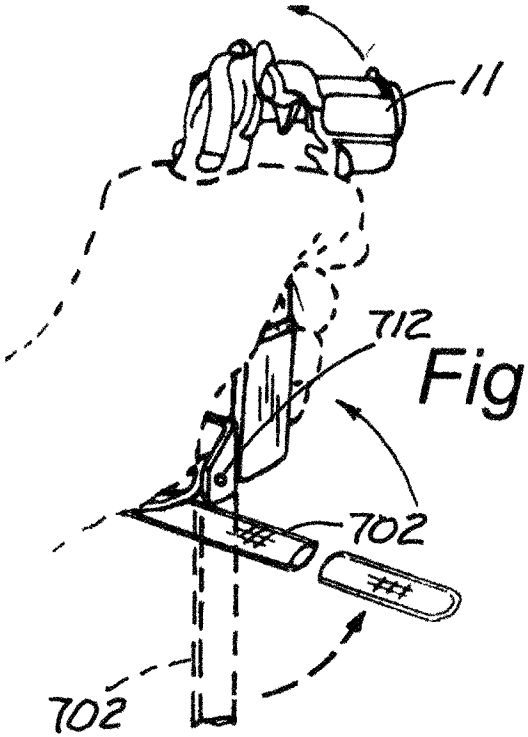
FIG. 42 is a left-handed version of apparatus shown in FIGS. 38 through FIG. 41D and shows if the left-handed user turns his/her hand quickly in a counterclockwise direction, the strap will move from the dashed line position shown in FIG. 42, first to the solid line position shown in FIG. 42 in a similar fashion as shown in FIG. 41A-FIG. 41B, to the final position around the wrist of the user as shown in FIG. 43.
Figure 46:
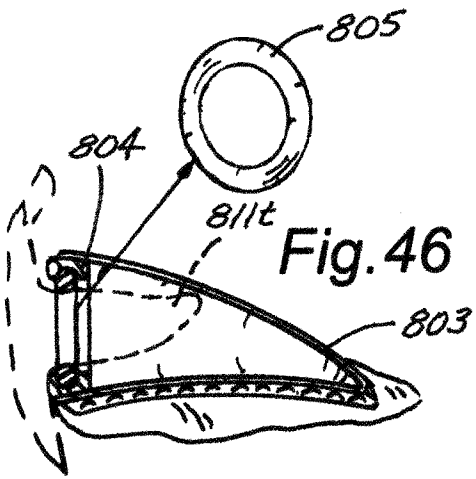
FIG. 46 is an enlarged cross sectional view taken along line 46-46 of FIG. 45.

Referring to FIGS. 42-44, the strap (702) is shown in a left hand version. By attachment to the opposite side of the bracket (712), the strap (701) will attach to the wrist of the left handed user when the user moves his or her hand in a counterclockwise direction as shown in FIG. 42, whereby the strap (702) shown in dashed lines in FIG. 42 will quickly move from the dashed line position to the solid line position and immediately continue to wrap around the user's wrist as shown by a top view in FIG. 43 and a side view as shown in FIG. 44. To release the strap (702) from the user, the strap (702) is merely straightened out to the position shown in FIGS. 37 and 38. As explained above, the strap (702) will remain in that straight position until it is forced out of the straight position whereupon it will automatically start to curl.

Figure 48:
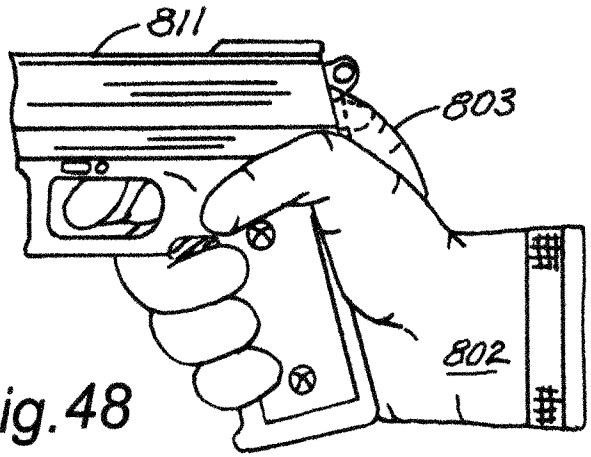
FIG. 48 is a partial view from the opposite side of the handgun that is shown in FIG. 47 with the o-ring structure attached to the tail of the handgun.
Figure 45:
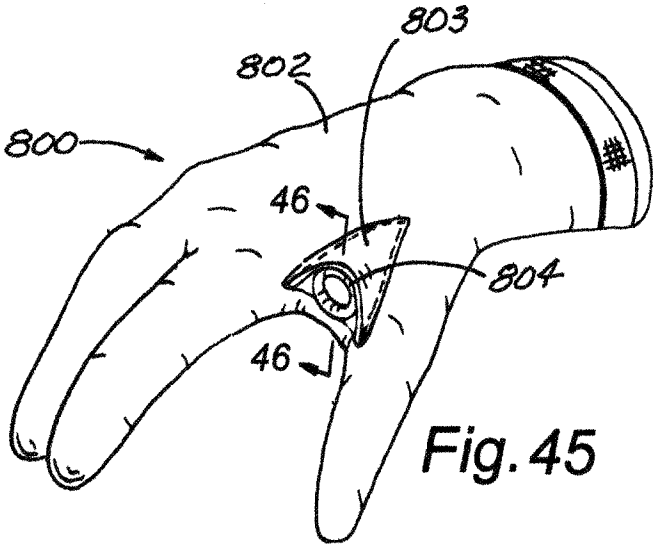
FIG. 45 is still another embodiment, part of which is shown in a glove in a perspective view.
Figure 47:
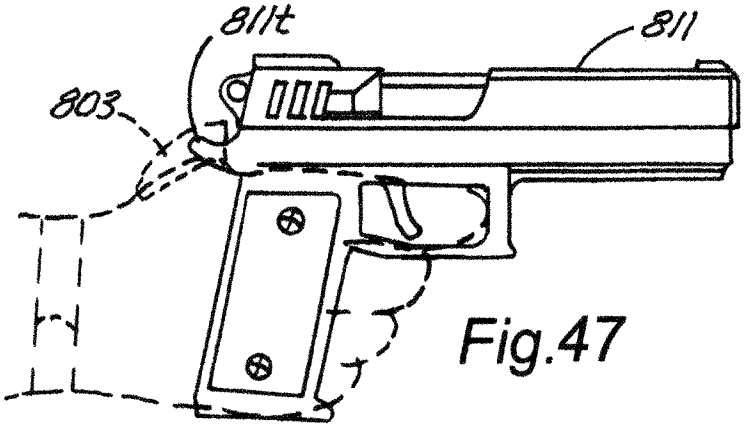
FIG. 47 shows a person's hand grasping the handgun and a tail of a standard handgun, such as a GLOCK® brand handgun, being received in an O-ring, like that shown in FIG. 46.

Still another embodiment of the present invention is shown in FIGS. 45-48 wherein a glove (802) has a pocket (803) thereon. This pocket is stitched in place by stitches (804). The pocket (803) has a seat (804) therein into which a rubber O-ring (805) will fit. This rubber O-ring (805) is replaceable and various sizes can be placed inside the seat (804) depending on the size of a tail (811*t*) of a handgun (811). Some GLOCK® brand handguns have such a tail (811*t*), for example. Consequently, when a user has the glove on and grabs the handgun (811) as shown in FIGS. 47 and 48, the O-ring (805) automatically goes around and attaches by friction to the tail (811) because the tail is progressively larger than the O-ring (805) closer to the base of the tail (811*t*) and progressively smaller farther from the free end of the tail (811*t*). Accordingly the farther the O-ring (805) goes over the tail (811*t*) the tighter the O-ring (805) grips the tail (811*t*), thereby keeping the glove (802) from being separated from the handgun (81).

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept as expressed by the attached claims.

The invention claimed is:

1. An apparatus for preventing a user from dropping a hand gun, the gun having a handle, the apparatus comprising:

a grip attached to one side of the handle of the gun (11), the grip having two holes therein for receiving threaded fasteners (504) there through; and the threaded fasteners extending through ends of a flexible loop (501) operatively attached to the grip, the flexible loop (501/601) being of a size to tightly hold a human hand gripping the handle of the gun.

2. The apparatus of claim 1 including a compressible elastomeric pad (502) attached to the inside of the flexible loop (501) for pushing against a human hand to help prevent the hand from easily coming out of the flexible loop.

3. The apparatus of claim 1 further comprising a wrist strap (605) attached to the flexible loop (601).

4. The apparatus of claim 3 wherein the connection of the wrist strap (605) to the flexible loop (601) includes a hinge (606).

5. The apparatus of claim 3 wherein the wrist strap (605) has complementary hook and loop fasteners (610*a*/610*b*) attached thereto at two ends of the wrist strap (606).

6. The apparatus of claim 1 wherein the flexible loop (601) has a knuckle protection member disposed therein.

* * * * *